United States Patent [19]

von Dorp et al.

[11] 4,242,894

[45] Jan. 6, 1981

[54] METHOD AND APPARATUS FOR PRODUCING THIN TUBES IN A SKEW-ROLLING MILL

[75] Inventors: Walter von Dorp, Monchen-Gladbach; Heinrich Steinbrecher, Meerbusch, both of Fed. Rep. of Germany

[73] Assignee: Wean United, Inc., Pittsburgh, Pa.

[21] Appl. No.: 21,367

[22] Filed: Mar. 16, 1979

[30] Foreign Application Priority Data

Mar. 31, 1978 [DE] Fed. Rep. of Germany ..... 2814493

[51] Int. Cl.[3] ..... B21B 19/06

[52] U.S. Cl. ..... 72/96; 72/370

[58] Field of Search ..... 72/95, 96, 97, 98, 100, 72/240, 224

[56] References Cited

U.S. PATENT DOCUMENTS 2,060,768 11/1936 Assel ..... 72/96

2,336,397 12/1943 Harrington ..... 72/96

FOREIGN PATENT DOCUMENTS 623595 9/1978 U.S.S.R. ..... 72/96

*Primary Examiner*—Milton S. Mehr

*Attorney, Agent, or Firm*—Daniel Patch; Suzanne Kikel

[57] ABSTRACT

A method and apparatus for producing a thin metallic tube having a trailing end portion which optionally can be formed with an external diameter substantially corresponding to or varying from that of the remaining rolled portion of the tube rolled in a three roller skewed rolling mill. This is accomplished by causing an angular unisonal displacement of the roller axes to effect an enlargement of the rolling area, and at least during part of the roller movement, a second movement of the roller perpendicular to the axis of the tube.

13 Claims, 9 Drawing Figures

METHOD AND APPARATUS FOR PRODUCING THIN TUBES IN A SKEW-ROLLING MILL

Figure 1:
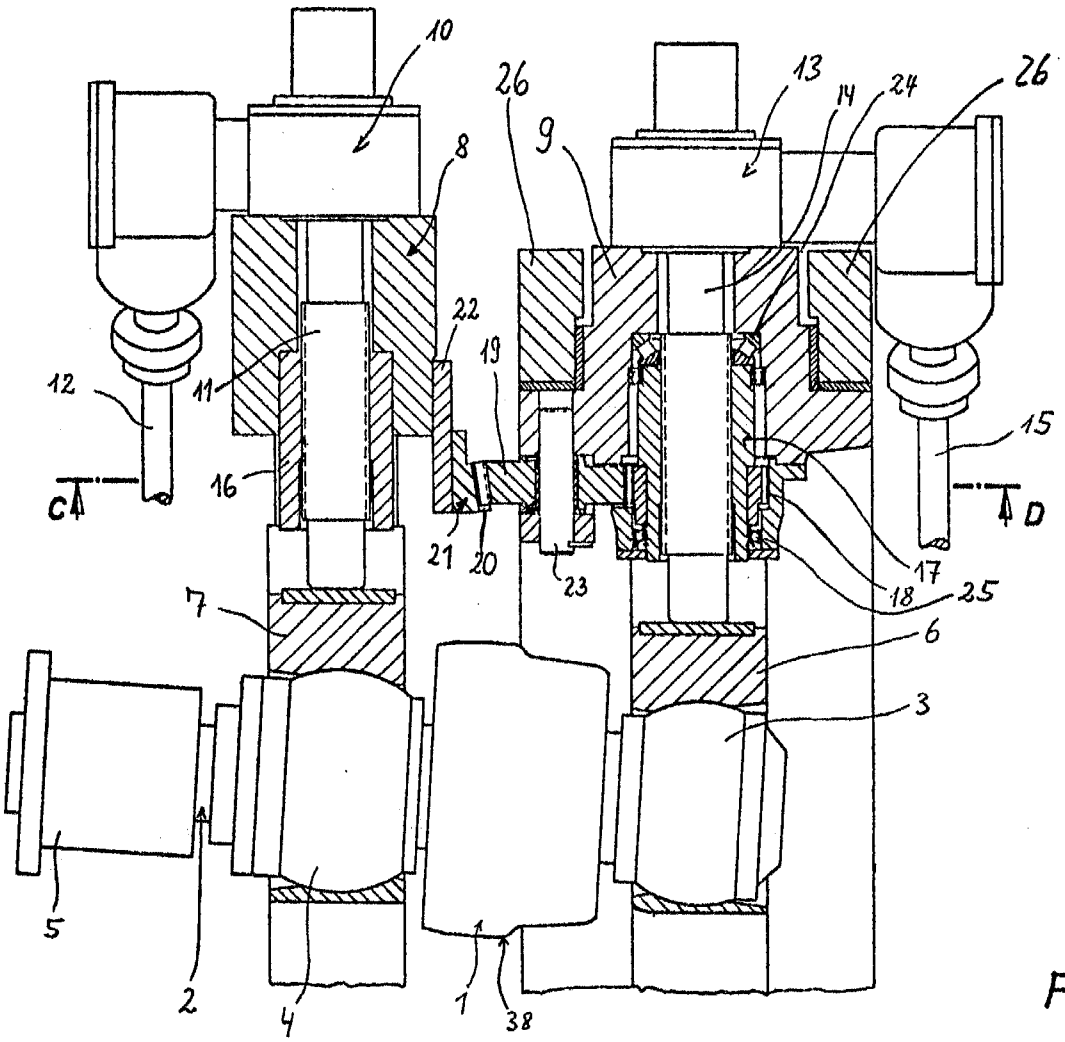

The invention relates to a process and apparatus for producing thin tubes in a skew-rolling mill usually of the three roller type known as an Assel rolling mill. In the production of thin steel tubes as disclosed in DT-AS No. 15 27 750 shortly before the rear end of the blank is introduced into the rolling area, the angle between the rotation axes of the inclined rollers and the axis of the rolled tube is suddenly reduced in order to increase the thickness of the end of the rolled tube. The increase in diameter does, admittedly, enable tubes to be rolled to a wall thickness which is less than 1/11 of the external diameter of the rolled tube, but with the known process the retention of this wall thickness would lead to problems when rolling the end portion and would result in a clover leaf-shaped cross section of the tube; this would very quickly block or tear the blank or could cause damage to the skew-rolling mill. Thus, in the known process, a thickened end, and hence, a corresponding wastage are taken into account, in the interest of trouble-free rolling.

However, a thickened end is not regarded as wastage in those cases where tubes with thickened ends are required. Such a case is the production of oilfield pipes in which the thickened ends are provided with an internal or external thread, as disclosed in U.S. Pat. No. 2,336,397. Again, the measures proposed in DT-AS No. 1 527 750 are inadequate, since it is scarcely possible thereby to increase the wall thickness by more than 2.2 mm in the end region. Therefore, different measures must be taken to obtain the desired degree of thickening of the ends. One solution is to enlarge the roller gap, as proposed in DT-AS No. 1 752 349. One such means for enlarging the roller gap is known in the form of a rapidly adjustable spindle in an apparatus used in shoulder-type rolling mills for draw-rolling tubes according to DT-OS No. 1 939 778.

It should also be pointed out that skew-rolling mills according to the essence of the present invention, i.e. so-called Assel rolling mills, are frequently found in average tube rolling mills and have to adapt to a wide range of finished tube dimensions.

An object of the present invention is to take the above disadvantage into account, and to provide a skew-rolling process and apparatus for producing thin tubes wherein thickened ends are not generally produced, i.e. a process and apparatus which considerably increases the output of a tube rolling mill. However, the process and apparatus should also be sufficiently flexible so that, if necessary, tubes with exaggeratedly thickened ends can be obtained.

Another object of the present invention is to provide a method and apparatus used in a three-roller skew-rolling mill to compensate for an increase in the diameter of the tube which is inherently caused by the reduction in the adjustment angle of the inclined rollers by the simultaneous adjustment of the inclined rollers towards the center of the rollers. These measures ensure that the so-called high point of the inclined rollers provided with shoulders, i.e. the pass area of the inclined rollers which determines the external diameter of the rolled tube, substantially retains its position relative to the roller axis. On the other hand, the less inclined position reduces the advance of the blank and thus leads to reduced widening, thereby preventing undesirable deformation of the cross section of the tube in the vicinity of its end, as mentioned above, in an area not reached by the progress according to the prior art.

Another object of the present invention is to provide a method of producing a thin walled tube wherein a mandrel is inserted in a blank generally parallel to the direction of rolling and the blank is rolled between skewed rollers forming a rolling area in a rolling mill, each roller having an end mounted in a stationary housing and an end mounted in a rotatable housing, the skewed rollers having cooperating shouldered rolling surfaces defining high points wherein upon contact with the blank, the wall is reduced to a relatively small wall thickness compared to the outer diameter of the rolled tube, comprising the steps of: (a) shortly before the end of the blank is introduced into the rolling area, pivoting the rotation axes of the rollers about a point remote from the rolling area in the direction of rolling and remote from the high points of the rollers to reduce the adjustment angle between the rotation axis of the inclined rollers and the axis of the rolled tube to effect a change in the rolling action between the rollers and the blank which reduction of angle causes an enlargement of said rolling area, and (b) with respect to the enlargement of said rolling area, superimposing a further movement of the skewed rollers in the form of an adjustment movement of the rollers at right angles to the direction of rolling to thereby obtain a rolling condition more conducive to rolling the end portion of the blank.

A still further object of the present invention is to provide a rolling mill for producing a thin walled tube wherein a rotatable mandrel is inserted in a blank and the blank is rolled between a plurality of skewed rollers forming a rolling area in the mill, said mill further comprising: a stationary flange, and a rotatable flange arranged coaxially with said stationary flange, said rollers having first common ends rotatably mounted in said stationary flange and opposite common ends rotatably mounted in said rotatable flange, said ends being arranged in corresponding inclined positions relative to the axis of said tube, roller adjusting means for each roller in each said flange for adjusting said skewed rollers orthogonally relative to said workpiece, and means for causing rotation of said rotatable flange to effect a simultaneous change in the inclined positions of said skewed rollers and for causing a simultaneous operation of said roller adjusting means arranged in said rotatable flange during at least a period of the simultaneous adjustment of said skewed rollers.

A further object of the present invention is to provide a method and apparatus in a skew rolling mill to produce a tube without a thickened end or a tube with a considerably thickened end.

Figure 2:
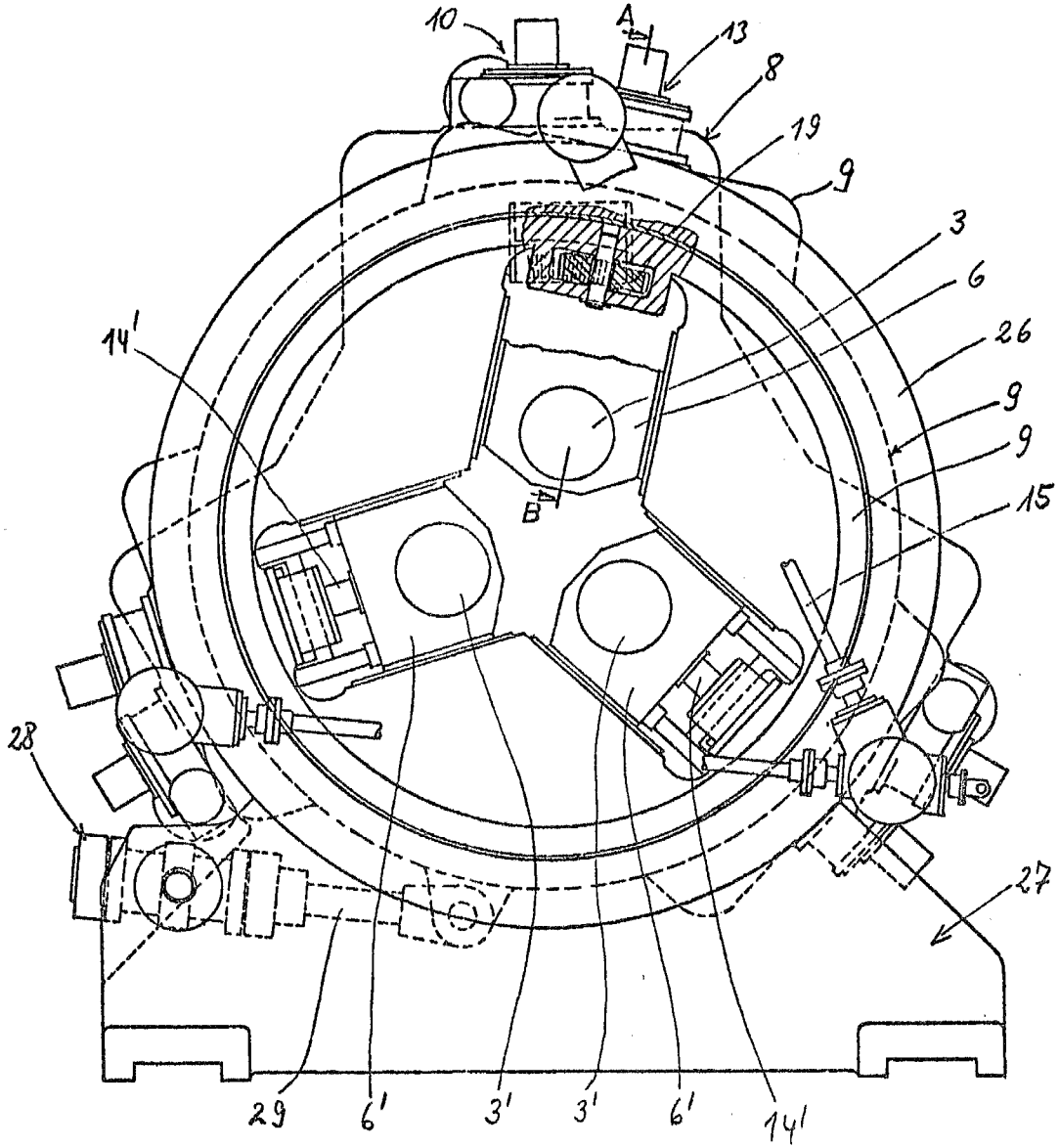
Figure 3:
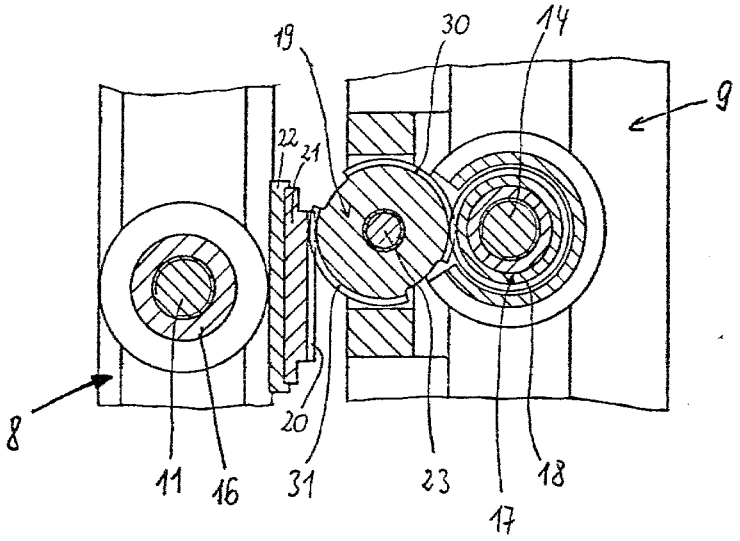
Figure 4:
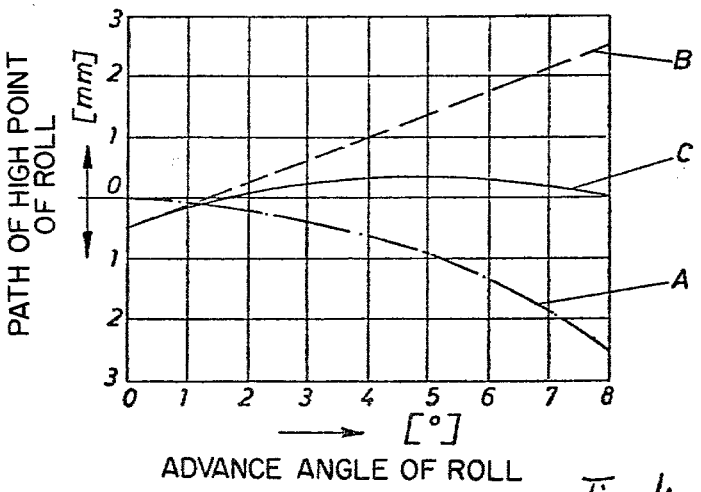
Figure 5:
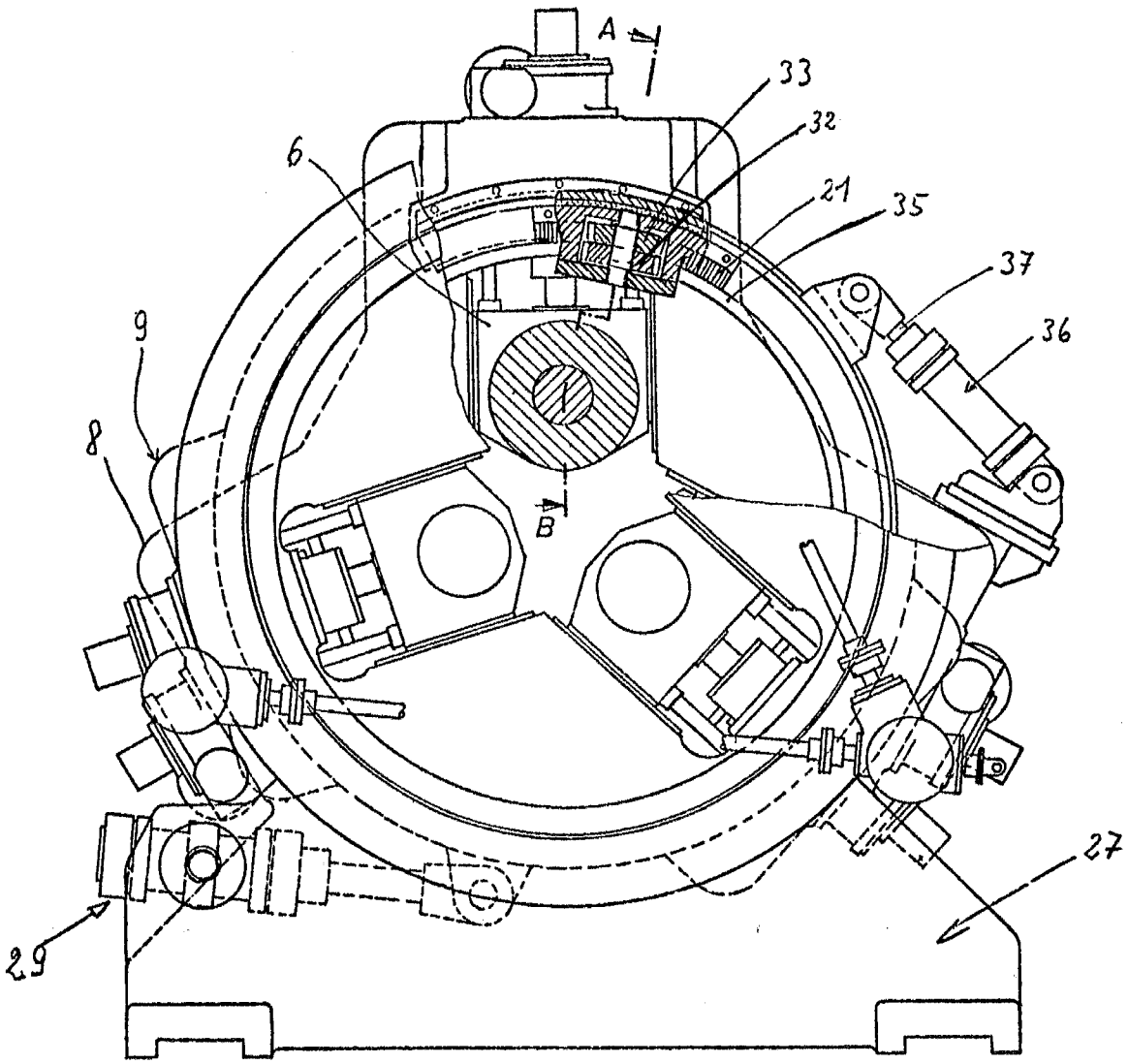
Figure 6:
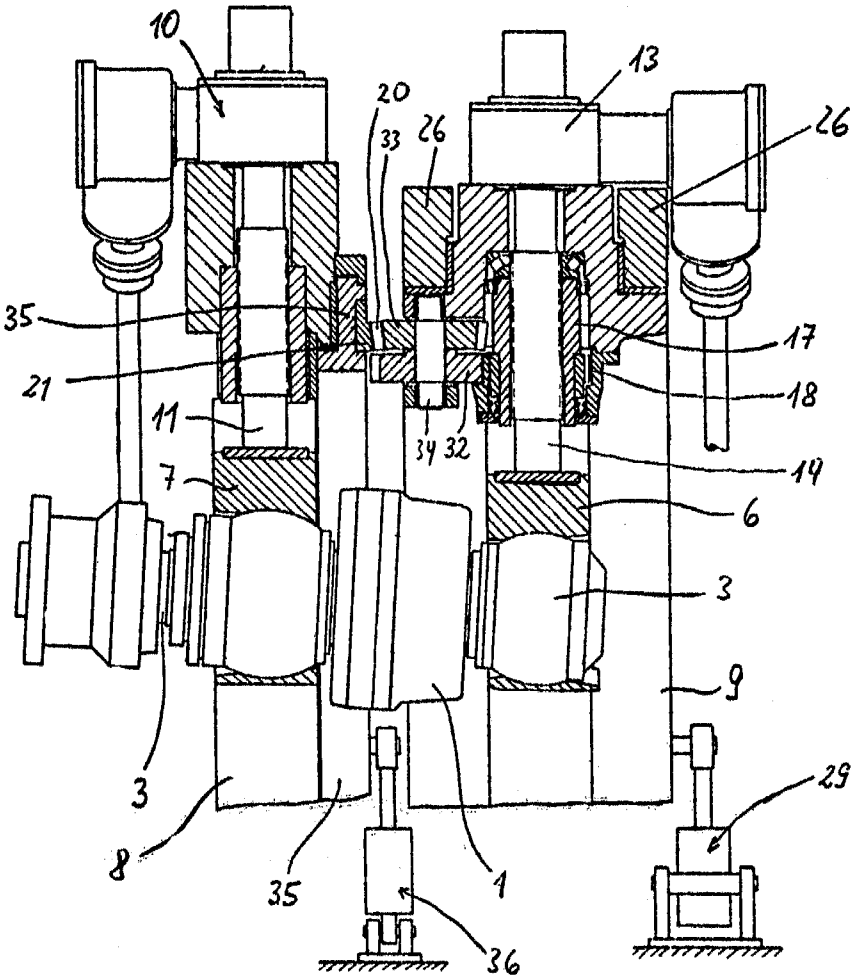

These objects, as well as other novel features and advantages of the present invention will become more apparent when the following description is read along with the accompanying drawings, of which:

FIG. 1 is a partial section through a skew rolling mill taken on the lines A–B of FIG. 2, FIG. 2 shows a three-roller skew rolling mill, viewed in the direction of rolling, FIG. 3 is a detail section view taken along lines C–D of FIG. 1, FIG. 4 is a diagram of the path of the high point of the inclined roller, FIG. 5 illustrates a second embodiment of the present invention, FIG. 6 shows a partial section taken on line A–B in FIG. 5, FIGS. 7, 8 and 9 are diagrams of the path of the high point of the inclined roller.

Although FIG. 2 shows a three-roller skew rolling mill in its entirety, the invention will first be described with reference to FIG. 1, since this figure clearly shows the construction according to the essence of the subject invention.

The three roller skew rolling mill partially shown in FIG. 1 shows one of three inclined rollers 1, which is constructed as a shouldered roller. On this inclined roller 1, the position of the high point 38 at which the forming of a blank into a tube is completed is shown. The inclined roller 1 is associated with a roller spindle 2 which is mounted in mounting members 6 and 7 via pivot bearings 3 and 4. A coupling 5 connects a drive shaft (not shown) which creates the rolling motion of the inclined roller 1.

The rolling stand consists of a fixed flange or housing 8 and a movable flange or housing 9 rotatably mounted in annular, fixed housing portions 26. Mounting members 7, 6 are mounted in the flanges 8, 9 via threaded spindles 11, 14 so as to be movable at right angles to the roller axis. The threaded spindles 11, 14 are driven by adjustment devices 10, 13 associated with drive shafts 12, 15. The threaded spindle of the fixed flange 8 is rotatable by means of the adjustment device 10 via a sleeve-type spindle nut 16 connected to the fixed flange 8, and displaces the mounting member 7 as it rotates. During the rolling process itself, the position of the threaded spindle 11, once set up, is maintained.

Basic adjustment of the mounting member 6 is effected in a similar way via the threaded spindle 14 associated with the movable flange 9, while a threaded sleeve 17 acts as the spindle nut in this case.

However, the threaded sleeve 17 comprises external teeth 18 which mesh with a toothed wheel 19 which is rotatably mounted on a spindle 23 on the movable flange 9 and in turn meshes with the teeth 20 of a toothed rack 21. The toothed rack 21 is attached to the fixed flange 8 via an intermediate ring 22. Moreover, the threaded sleeve 17 is mounted in the movable flange 9 via radial bearings 25 and a radial-axial bearing 24.

The movable flange 9 is thus coupled to the fixed flange 8 via gear, of which the toothed wheel 19 is a part. This geared connection is shown more clearly in FIG. 3. It can be seen that the toothed wheel 19 comprises two different toothed segments 30, 31, of which toothed segment 30 meshes with the threaded sleeve 17 and toothed segment 31 meshes with the toothed rack 21. The diameter of the toothed segment 30 may be 5% greater than the diameter of the toothed segment 31.

In FIG. 2 three rollers are arranged in a skew rolling mill, which is a shoulder type rolling mill and as mentioned earlier, is known as an Assel rolling mill. The fixed flange 8 and the fixed housing portions 26 are fixedly connected to a stand 27. The movable flange 9, which is marked several times for the sake of clarity, is rotated by means of a rotating means 28 in the form of a pneumatic or hydraulic cylinder, the actuating piston 29 of which is hingedly connected to the movable flange 9. FIG. 2 shows, in addition to the pivot bearing 3 and the mounting member 6 of the first inclined roller 1, the corresponding pivot bearings 3′ and mounting members 6′ of the other inclined rollers. Reference numeral 14′ designates the threaded spindles of these other inclined rollers.

The operation of the skew rolling mill shown in FIGS. 1–3 is hereinafter described.

During rolling of a blank, the skew rolling mill is in the position shown in FIG. 1, for example, with the high point 38 occupying its nearest position to the axis of the tube; i. e. a tube with thin walls is being rolled, and the inclined position of the shaft axis 2 is relatively great, thus producing a relatively large advance during rolling. Shortly before the rear end of the blank is reached, the inclined position of the roller spindle 2 is reduced by actuating the rotating means 28 and thus rotating the movable flange 9. As the movable flange 9 rotates, the toothed wheel 19 travels along the toothed rack 21 of the fixed flange 8 and thereby turns the threaded sleeve 17. Since the threaded sleeve 17 is mounted in axially immovable manner in the movable flange 9, it displaces the mounting member 6 towards the rolling line as it rotates and thus largely compensates for the migration of the high point 38 from the rolling line, which is caused by the reduction in the inclined position of the roller spindle 2. Owing to the change in the inclined position, the high point migrates along a curved line, which is shown by broken line A in FIG. 4.

By means of the two different toothed segments 30 and 31, the kinematics of this gear movement, i.e. this mechanical coupling, causes to be superimposed on this line A, a linear counter-movement caused by the rotation of the sleeve; this is designated as B in the diagram. A third curved line C results from the two superimposed movements, and brings certain deviations of the order of 0.3–0.4 mm from the wall thickness of the rolled tube. These slight deviations can be balanced out without any special operations during the later processing of the rolled tube to form the finished tube. Generally, tubes without thickened ends and uniform wall thickness are produced according to the invention of FIGS. 1–4.

FIG. 5 shows a three roller skew rolling mill with which it is possible to roll out tubes without thickened ends, by operating in the same way as the rolling mill according to FIGS. 1 to 4, or else to produce tubes with normally or exaggeratedly thickened ends. This is achieved by fixing the toothed rack 21 itself to a movable rotatable ring 35, while the rotatable ring 35 can assume various positions by means of a rotating means 36 or can perform specific movements. As shown in FIG. 6, the coupling of the threaded sleeve 17 of the movable flange 9 to the fixed flange 8 is again accomplished by means of a type of gearing arrangement. Threaded sleeve 17 engages with a toothed wheel 32 mounted on a shaft 34 in the movable flange 9. Connected to toothed wheel 32 in a manner so that there is no relative rotation therebetween is another toothed wheel 33 which in turn meshes with the teeth 20 of the toothed rack 21. The toothed rack 21 is fixedly connected to the movable ring 35 on which the rotating means 36 act.

Figure 7:
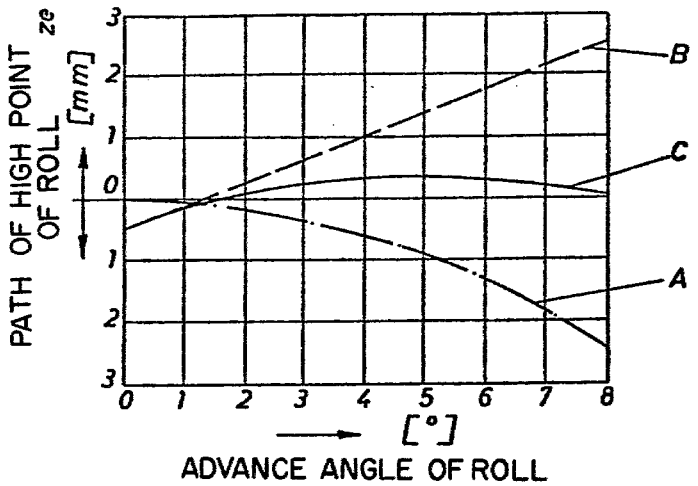

If the rotating means 36 are switched to idling, so to speak, the toothed wheel 33 moves the toothed rack 21 as the movable flange 9 rotates, and thus turns the movable ring 35; however, the threaded sleeve 17 does not move producing a normal enlarged thickened end. If, during rotation of the movable flange 9, the movable ring 35 is positively rotated in the same direction of the flange 9 or in the opposite direction via the adjusting means 36, a tube with a considerably thickened end of a tube with a tapered end is produced, respectively. This is explained in more detail with reference to FIGS. 7 to 9. FIG. 7 corresponds in diagrammatic form to FIG. 4. It should also be mentioned that some compensation of the deviations in the curve A from the linear curve B to a curve C located in the correct position can be effected due to the different diameters of the toothed segments 30 and 31 in FIG. 3, i.e. in a skew rolling mill according to FIGS. 1 to 3, and due to the different diameters of the toothed wheels 32 and 33 according to FIG. 6. This is assuming that rolling is normally carried out with a roller advance angle of 8° and this angle is reduced to 3° in the region of the end of the tube.

Thus, to obtain the arrangements shown in FIG. 7 or FIG. 4 with a skew rolling mill according to FIGS. 5 and 6, the movable ring 35 is clamped in place by blocking the rotating means 36.

To obtain a tube with a normally thickened end, i.e. with a thickening at the end of approximately 2.2–2.4 mm, the movable ring 35 is switched to the same direction and same angular course by the idling mode of means 36 as the movable flange 9 rotates, thus creating the conditions conventionally found in the apparatus of this type.

Figure 8:
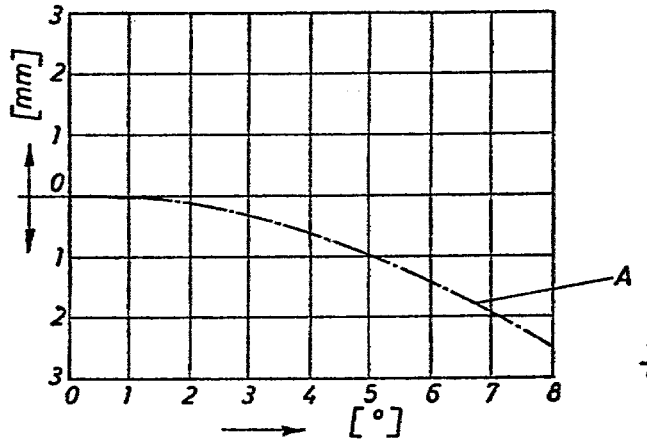
Figure 9:
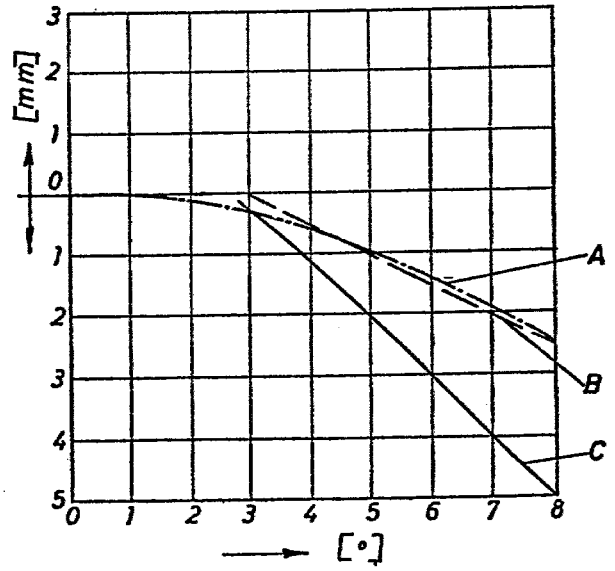

FIG. 9 shows the production of tubes with greatly thickened ends, while here the broken curve A shown in FIG. 8 already has another broken curve B superimposed on it and the curve C is produced. This is obtained by the fact that the movable ring 35 is moved a certain amount in the same direction of rotation as the movable flange 9 while the movable flange rotates. As shown in FIG. 9, the movement of the movable ring 35 can start somewhat later and yet end at the same time as the rotation of the movable flange 9 ends.

There is a further variant of the invention (not shown) which is of secondary importance in normal rolling, whereby the end of the tube may even be tapered by means of a corresponding counter-movement of the movable ring 35.

In accordance with the provisions of the patent statutes, we have explained the principle and operation of our invention and have illustrated and described what we consider to represent the best embodiment thereof.

We claim:

1. In a method of producing a thin walled tube wherein a mandrel is inserted in a blank generally parallel to the direction of rolling and the blank is rolled between skewed rollers forming a rolling area in a rolling mill, each roller having an end mounted in a stationary housing and an end mounted in a rotatable housing, the skewed rollers having cooperating shouldered rolling surfaces defining high points wherein upon contact with the blank, the wall is reduced to a relatively small wall thickness compared to the outer diameter of the rolled tube, comprising the steps of:

(a) shortly before the end of the blank is introduced into the rolling area, pivoting the rotation axes of the rollers about a point remote from the rolling area in the direction of rolling and remote from the high points of the rollers to reduce the adjustment angle between the rotation axis of the inclined rollers and the axis of the rolled tube to effect a change in the rolling action between the rollers and the blank which reduction of angle causes an enlargement of said rolling area, and (b) with respect to the enlargement of said rolling area, superimposing a further movement of the skewed rollers in the form of an adjustment movement of the rollers at right angles to the direction of rolling to thereby obtain a rolling condition more conducive to rolling the end portion of the blank.

2. In a method of producing a thin walled tube according to claim 1 wherein step (b) is effected simultaneously for at least a portion of step (a).

3. In a method of producing a thin walled tube according to claim 1 wherein step (b) further includes the step of reducing the rolling area to offset the enlargement thereof effected by step (a) to roll the end portion of the tube to an external diameter and a wall thickness substantially corresponding to that of the previous portion of the rolled tube.

4. In a method of producing a thin walled tube according to claim 1 wherein step (b) further includes the step of enlarging the rolling area to augment the enlargement effected by step (a) to thereby roll the end portion of the tube to a greater external diameter than that of the previous portion of the rolled tube.

5. A rolling mill for producing a thin walled tube wherein a rotatable mandrel is inserted in a blank and the blank is rolled between a plurality of skewed rollers forming a rolling area in the mill, said mill further comprising:

a stationary flange, and a rotatable flange arranged coaxially with said stationary flange, said rollers having first common ends rotatably mounted in said stationary flange and opposite common ends rotatably mounted in said rotatable flange, said ends being arranged in corresponding inclined positions relative to the axis of said tube, roller adjusting means for each roller in each said flange for adjusting said skewed rollers orthogonally relative to said workpiece, and means for causing rotation of said rotatable flange to effect a simultaneous change in the inclined positions of said skewed rollers and for causing a simultaneous operation of said roller adjusting means arranged in said rotatable flange during at least a period of the simultaneous adjustment of said skewed rollers.

6. A rolling mill according to claim 5 wherein said means for causing said operation of said roller adjusting means includes driven means and wherein said means for causing said rotation of said rotatable flange includes power means, the arrangement and construction being such that said rotation of said rotatable flange causes operation of said driven means.

7. A rolling mill according to claim 6 wherein said driven means includes gear means.

8. A rolling mill according to claim 5 wherein said roller adjusting means arranged in said rotatable flange includes sleeve means having external teeth, and wherein said means for causing said operation of said roller adjusting means arranged in said rotatable flange includes a gear rack means fixedly mounted to said stationary flange, and pinion means rotatably mounted in said rotatable flange for meshing with said gear rack means and said external teeth of said sleeve means.

9. A rolling mill according to claim 8 wherein said pinion means comprises at least two toothed segments of different diameters, the diameter of the toothed segment associated with said sleeve means being greater than the diameter of the toothed segment associated with said gear rack means.

10. A rolling mill according to claim 5 wherein said roller adjusting means arranged in said rotatable flange includes sleeve means having external teeth, and wherein said means for causing said operation of said roller adjusting means arranged in said rotatable flange includes:

circular gear rack means rotatably mounted to said stationary flange and located coaxially relative to said rotatable and said stationary flanges, means for controlling movement of said circular gear rack means, and pinion means rotatably mounted in said rotatable flange for meshing with said circular gear rack means and said external teeth of said sleeve means.

11. A rolling mill according to claim 10 wherein said pinion means includes two separate pinions of different diameters mounted on a common shaft and connected in a manner to transmit rotation from one to the other, one pinion arranged to mesh with said sleeve means and the other pinion arranged to mesh with said gear rack means.

12. A rolling mill according to claim 10 wherein said means for controlling said movement of said circular gear rack means and said means for causing rotation of said rotatable flange includes power means.

13. A rolling mill according to claim 12 wherein said power means includes separate power means, one arranged and constructed to effect said rotation of said rotatable flange, and the other power means arranged and constructed to effect and capable of optionally (1) holding said gear rack means from rotating; (2) allowing said gear rack means to rotate freely on rotation of said rotatable flange, or (3) effecting a positive rotation thereof either in the direction of said rotatable flange, or in the opposite direction thereof.

* * * * *

UNITED STATES PATENT AND TRADEMARK OFFICE

CERTIFICATE OF CORRECTION

PATENT NO. : 4,242,894

DATED : January 6, 1981

INVENTOR(S) : Walter vom Dorp and Heinrich Steinbrecher

It is certified that error appears in the above-identified patent and that said Letters Patent are hereby corrected as shown below:

The name of the first inventor Walter von Dorp should read -- Walter vom Dorp--

Column 2, line 3 "progress" should read -- process--

Signed and Sealed this

Twenty-eighth Day of April 1981

[SEAL]

Attest:

RENE D. TEGTMEYER

Attesting Officer

Acting Commissioner of Patents and Trademarks